US011528962B2

(12) United States Patent
Kim

(10) Patent No.: US 11,528,962 B2
(45) Date of Patent: Dec. 20, 2022

(54) SHOCK-ABSORBING SHOE USING SPRING

(71) Applicant: Gi Yeon Kim, Busan (KR)

(72) Inventor: Gi Yeon Kim, Busan (KR)

( * ) Notice: Subject to any disclaimer, the term of this patent is extended or adjusted under 35 U.S.C. 154(b) by 0 days.

(21) Appl. No.: 17/275,953

(22) PCT Filed: Sep. 9, 2019

(86) PCT No.: PCT/KR2019/011643

§ 371 (c)(1),
(2) Date: Mar. 12, 2021

(87) PCT Pub. No.: WO2020/055064

PCT Pub. Date: Mar. 19, 2020

(65) Prior Publication Data

US 2022/0053881 A1 Feb. 24, 2022

(30) Foreign Application Priority Data

Sep. 13, 2018 (KR) ..... 10-2018-0109708

(51) Int. Cl.

| | |
|---|---|
| ***A43B 13/30*** | (2006.01) |
| ***A43B 21/30*** | (2006.01) |
| ***A43B 13/18*** | (2006.01) |
| ***A43B 21/32*** | (2006.01) |

(52) U.S. Cl.

CPC ..... *A43B 21/30* (2013.01); *A43B 13/182* (2013.01); *A43B 13/183* (2013.01); *A43B 13/30* (2013.01); *A43B 21/32* (2013.01)

(58) Field of Classification Search

CPC ..... A43B 13/182; A43B 13/183; A43B 13/20; A43B 21/30; A43B 21/32

See application file for complete search history.

(56) References Cited

U.S. PATENT DOCUMENTS

| | | | | |
|---|---|---|---|---|
| 5,832,629 | A * | 11/1998 | Wen | A43B 21/30 36/38 |
| 8,365,439 | B2 | 2/2013 | Koh | |
| 2008/0313928 | A1 | 12/2008 | Adams et al. | |
| 2013/0055593 | A1 * | 3/2013 | Park | A43B 7/144 36/102 |

(Continued)

FOREIGN PATENT DOCUMENTS

| | | |
|---|---|---|
| JP | 08-107802 | 4/1996 |
| JP | 3142969 | 7/2008 |
| KR | 20-0341123 | 2/2004 |

(Continued)

*Primary Examiner* — Ted Kavanaugh

(74) *Attorney, Agent, or Firm* — Maschoff Brennan

(57) ABSTRACT

A shock-absorbing shoe using a spring, comprising: a spring for absorbing shock by providing an elastic force; an outsole which constitutes the bottommost sole of a shoe; an upper sole which is fixed to the top of the outsole, has a gap between the heel part thereof and the heel part of the outsole so as to provide a space in which the spring is provided, and is lowed by the weight of a user or raised by the elastic force of the spring; a lower spring seat which is formed on the upper surface of the outsole and supports the lower end part of the spring; an upper spring seat which is formed below the bottom of the upper sole and supports the upper end part of the spring; and a raising and lowering guide for guiding the lowering and raising of the upper sole straightly.

4 Claims, 6 Drawing Sheets

(56) References Cited

U.S. PATENT DOCUMENTS

| | | | | |
|---|---|---|---|---|
| 2016/0331077 | A1* | 11/2016 | Park | A43B 13/182 |
| 2022/0053881 | A1* | 2/2022 | Kim | A43B 13/183 |

FOREIGN PATENT DOCUMENTS

| | | | |
|---|---|---|---|
| KR | 200371481 | Y1 * | 12/2004 |
| KR | 10-2011-0030854 | | 3/2011 |
| KR | 10-1034656 | | 5/2011 |
| KR | 10-2012-0138030 | A | 12/2012 |
| KR | 10-1965401 | | 4/2019 |

* cited by examiner

SHOCK-ABSORBING SHOE USING SPRING

TECHNICAL FIELD

The present disclosure relates to a shock-absorbing shoe, and more particularly, to a shock-absorbing shoe capable of absorbing shock or load using a spring installed on the heel.

BACKGROUND ART

In general, shoes serve to reduce foot fatigue by protecting a person's feet and absorbing shock.

Recently, in order to more smoothly reduce shock, various types of functional shoes have been introduced. In particular, shoes that absorb shock using a spring have been released.

As related prior art technology, Korean Patent No. 10-1034656 discloses a shock-absorbing shoe.

The aforementioned prior art document discloses that the shoe includes a coil spring arranged as an elastic member between an outsole and an upper sole, a fixing member provided to upper and lower ends of the coil spring to fix the coil spring, a support member provided to hold the fixing member, and a connection pin provided to hold the coil spring through the support member.

When walking, such conventional shock-absorbing shoes perform a shock-absorbing function by the elastic force of the coil spring against shock applied thereto.

However, when the coil spring is compressed due to a certain load persistently applied to the coil spring, the conventional shock absorber as described above is subjected to severe shock according to contact between parts of the coil spring, and is thus broken or damaged.

In particular, the shock-absorbing shoe according to the conventional art as described above has a structure in which several components are coupled to each other. Thus, it causes increase in the number of components, making the manufacturing process complicated, and requiring a lot of manual work, thereby reducing productivity.

In addition, with the conventional technology, as the weight increases due to a large number of components, the function of shoes, especially for the elderly, is degraded. Further, due to various parts, noise is generated and durability decreases.

In addition, the conventional technology lacks an element capable of adjusting the elastic force of the spring.

Therefore, there is a need for a thickness measurement device based on new technology to overcome the issues of the conventional technology as described above.

Prior art documents in the technical field to which the present disclosure pertains include Korean Patent No. 10-1034656.

DISCLOSURE

Technical Problem

Therefore, the present disclosure has been made in view of the above issues, and it is one object of the present disclosure to provide a shock-absorbing shoe using a spring, which has a simplified configuration for absorbing shock or load through a spring installed on the heel portion of an outsole, and is capable of reducing weight and minimizing noise generation while improving productivity.

It is another object of the present disclosure to provide a shock-absorbing shoe using a spring, which is capable of preventing distortion of the spring by rectilinearly guiding ascent/descent of an upper sole on which the spring is installed.

In particular, it is an object of the present disclosure to provide a shock-absorbing shoe using a spring, which allows a member for guiding the ascent/descent of the upper sole to be coupled in a one-touch manner and prevents the same from being separated after coupling.

It is another object of the present disclosure to provide a shock-absorbing shoe using a spring, which is capable of adjusting the degree of shock absorption of the spring.

Technical Solution

The object of the present disclosure can be achieved by providing a shock-absorbing shoe using a spring, the shock-absorbing shoe including a spring configured to provide elastic force to absorb a shock; an outsole forming a sole of the shoe; an upper sole fixed to a top of the outsole and spaced apart from a heel of the outsole to provide a space for installation of the spring, the upper sole descending by a load or ascending by the elastic force of the spring; a lower spring seat formed on a top surface of the outsole to support a lower end of the spring; an upper spring seat formed on a bottom surface of the upper sole to support an upper end of the spring; and an ascent/descent guider configured to rectilinearly guide an ascent/descent of the upper sole.

The ascent/descent guider may include a guide shaft integrally protruding from the lower spring seat to be coaxially arranged with the spring; a shaft holder formed in a hole shape in the upper spring seat to allow the guide shaft to be fitted thereinto, the shaft holder being configured to move in a longitudinal direction of the guide shaft to guide the ascent/descent of the upper sole; and a shaft engagement portion formed on an upper portion of the guide shaft and having a larger outer diameter than the shaft holder, the shaft engagement portion being radially contractible and expandable to be engaged with the shaft holder so as not to be separated when fitted into the shaft holder.

The shaft engagement portion may include a split shaft integrally extending from an upper portion of the guide shaft, the split shaft being split to have an open upper end so as to be contracted by external force or restored by elastic force; and a split hook formed at the upper end of the split shaft in a conical shape, the split hook being fitted into the shaft holder by the constriction of the split shaft, and opened by restoration of the split shaft to be caught on the shaft holder.

The split shaft may have four split pieces radially formed on an upper portion of the guide shaft.

The shock-absorbing shoe may further include an elastic adjuster provided to at least one of the lower spring seat and the upper spring seat to adjust the elastic force of the spring.

For example, wherein the elastic adjuster may include a seat cap screwed to the lower spring seat or the upper spring seat to face an end of the spring, the seat cap being configured to compress the spring through forward rotation or release the spring through reverse rotation.

Advantageous Effects

In a shock-absorbing shoe using a spring according to an embodiment of the present disclosure, the spring disposed on the heel portion of the outsole is installed through a simplified configuration through an ascent/descent guider and a spring seat. Accordingly, productivity may be improved, and noise caused by parts may be reduced along with decrease in the weight of the shoe.

In addition, in a shock-absorbing shoe using a spring according to an embodiment of the present disclosure, an ascent/descent guider connects an outsole to an upper sole, and rectilinearly guides the ascent/descent of the upper sole to allow rectilinear compression of the spring. Accordingly, distortion of the spring and the upper sole may be prevented.

In addition, in a shock-absorbing shoe using a spring according to an embodiment of the present disclosure, a shaft engagement part constituting the ascent/descent guider is composed of a split shaft and a split hook, and thus may be easily connected to the shaft holder in a one-touch manner and may be prevented from being arbitrarily separated after being connected.

In addition, the shock-absorbing shoe using a spring according to an embodiment of the present disclosure may adjust the elastic force of the spring through the configuration of an elasticity adjuster, and also adjust the height of the upper sole.

The effects obtainable through the disclosed embodiments are not limited to the above-mentioned effects, and other effects not mentioned will be clearly understood by those skilled in the art to which the disclosed embodiments pertain from the following detailed description.

BEST MODE

Figure 1:
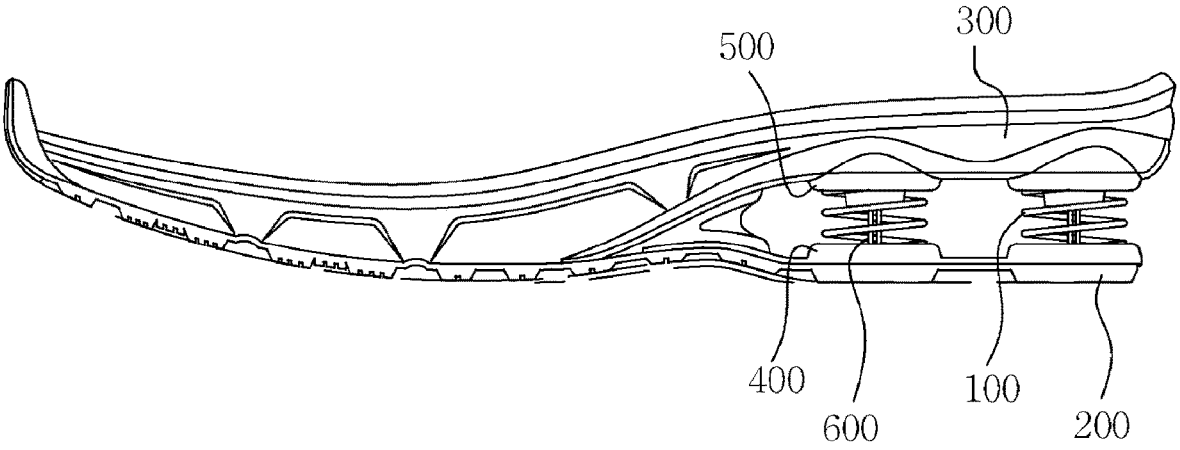
FIG. 1 is a block diagram showing a shock-absorbing shoe using a spring according to the present disclosure.

Hereinafter, embodiments of the present disclosure will be described in detail with reference to the accompanying drawings. In describing the present disclosure, detailed descriptions of related known general functions or configurations will be skipped.

Since the embodiments according to the inventive concept of the present disclosure may be subjected to various changes and have various forms, specific embodiments will be illustrated in the drawings and described in detail in the present specification or application. It should be understood, however, that this is not intended to limit the embodiments according to the inventive concept of the present disclosure to a specific form of disclosure, but is intended to include all changes, equivalents, and alternatives falling within the spirit and scope of the present disclosure.

In addition, terms including ordinal numbers such as first and second may be used to describe various elements, but the elements are not limited by the terms. These terms are used only for the purpose of distinguishing one element from another element.

When one element is mentioned as being "connected" or "linked" to another, it should be understood that this means the one element may be directly connected or linked to the other one or another element may be interposed between the elements. On the other hand, when one element is mentioned as being "directly connected" or "directly linked" to another, it should be understood that this means no other element is interposed between the elements. Other expressions describing the relationship between elements, such as "between" and "directly between" or "adjacent to" and "directly adjacent to" should also be interpreted in a similar manner.

Terms used in this specification are merely adopted to explain specific embodiments, and are not intended to limit the present invention. A singular expression includes a plural expression unless the two expressions are contextually different from each other. In this specification, "include" or "have" is intended to indicate that characteristics, figures, steps, operations, elements, and parts disclosed in the specification or combinations thereof exist. The term "include" or "have" should be understood as not precluding possibility of existence or addition of one or more other characteristics, figures, steps, operations, elements, parts, or combinations thereof.

Figure 2:
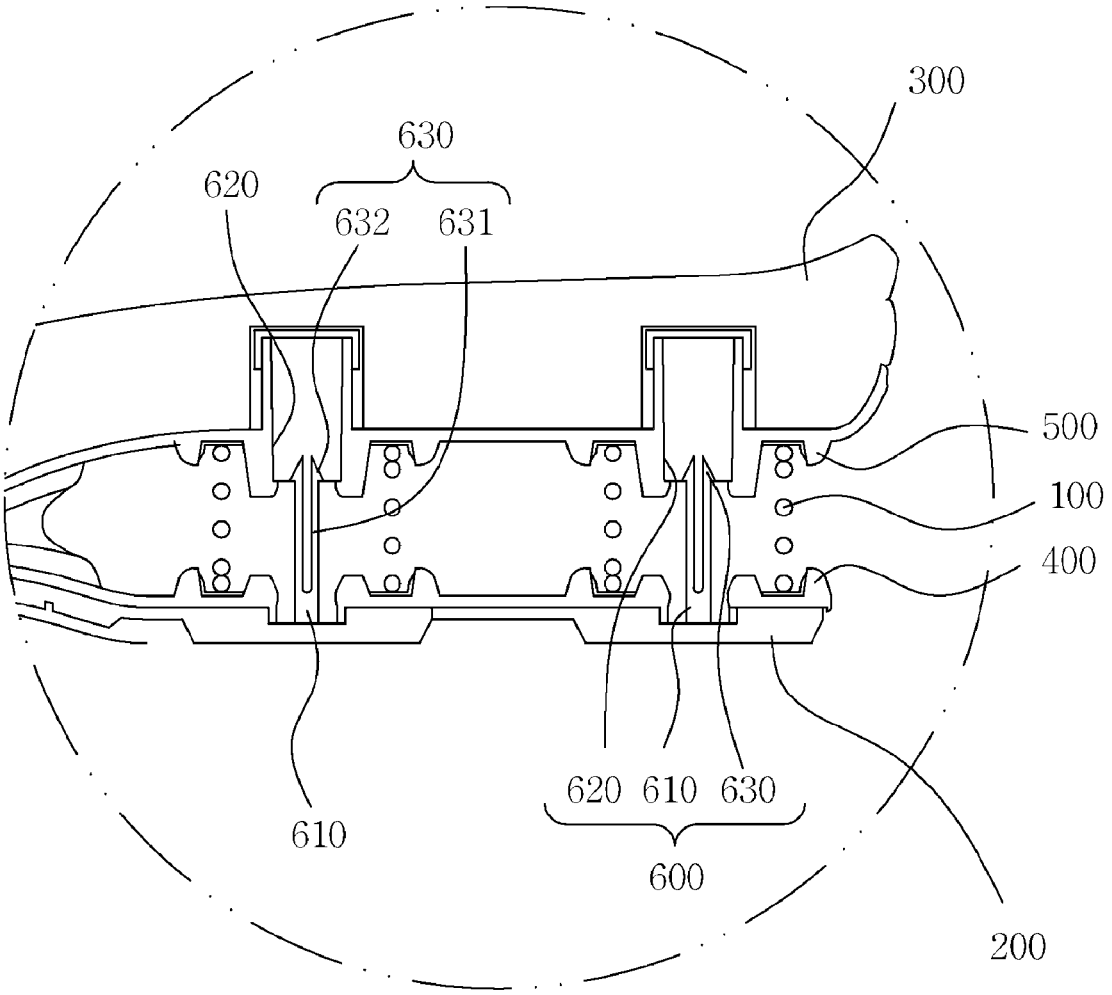
FIG. 2 is a longitudinal cross-sectional view showing main parts of the present disclosure.
Figure 3:
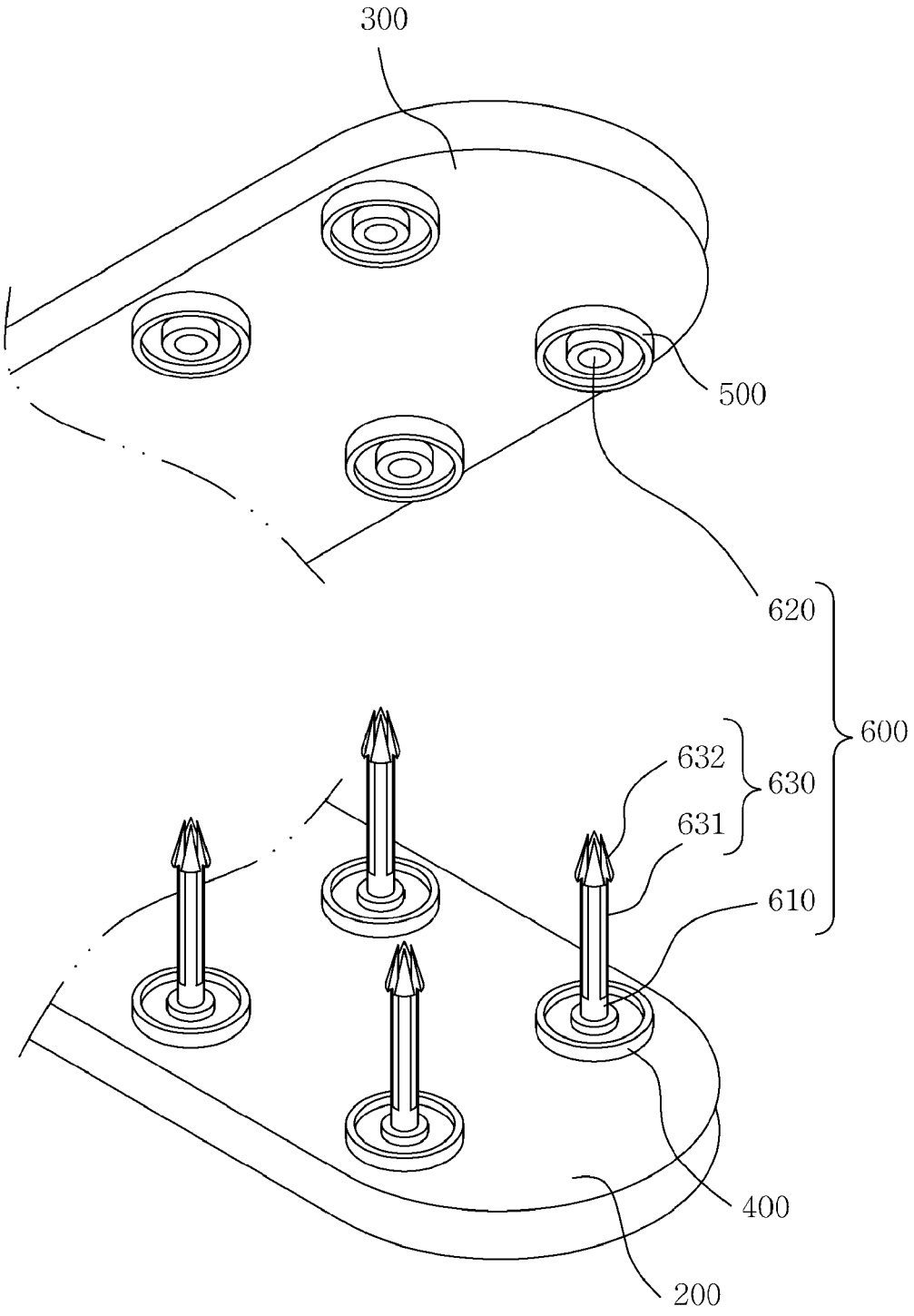
FIG. 3 is a perspective view showing the configuration of an ascent/descent guider of the present disclosure.
Figure 4:
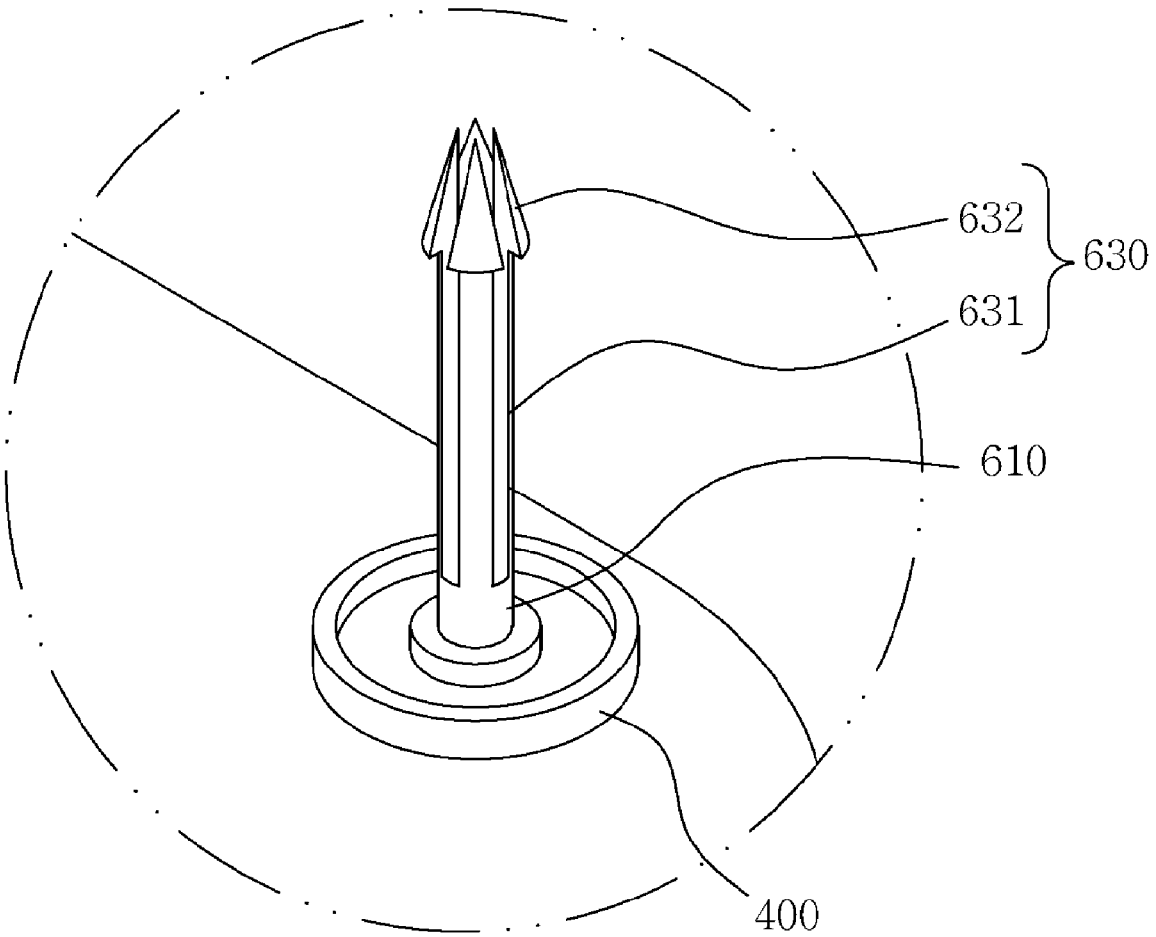
FIG. 4 is an enlarged perspective view showing the shaft engagement portion shown in FIG. 3.

FIG. 1 is a block diagram showing a shock-absorbing shoe using a spring according to the present disclosure, FIG. 2 is a longitudinal cross-sectional view showing main parts of the present disclosure, and FIG. 3 is a perspective view showing the configuration of an ascent/descent guider of the present disclosure. FIG. 4 is a perspective view showing the configuration of an elasticity adjuster of the present disclosure.

As shown in FIGS. 1 and 2, a shock-absorbing shoe using a spring according to an embodiment of the present disclosure may include a spring 100, an outsole 200, an upper sole 300, a lower spring seat 400, an upper spring seat 500, and an ascent/descent guider 600.

The spring 100 is a component configured to provide elastic force to absorb a user's weight or shock.

As shown in the figure, the spring 100 may include a coil spring and thus may be compressed by a load or shock to absorb the shock.

In addition, the spring 100 may include a coil spring having a circular cross-sectional shape, or may include a coil spring having a rectangular cross-sectional shape.

The outsole 200 is a part that constitutes the sole of the shoe and has a bottom surface contacting the ground. Preferably, the bottom surface is formed of a material having elasticity, such as elastomer, polyurethane (PU), or rubber, to absorb shock and resist against slip on the ground in contact therewith.

In addition, the outsole 200 may not only be formed of the elastic material to provide elasticity and anti-slip properties as described above, but also be provided, on the bottom surface thereof, with a protruding portion having multiple projections or bumps. Accordingly, it may have further improved functionality in terms of elasticity and anti-slip properties.

The upper sole 300 is a component that provides an installation space for the spring 100 together with the outsole 200.

Specifically, when the upper sole 300 is fixed to the top of the outsole, it is spaced apart from the heel portion of the outsole 200 to provide the installation space for the spring 100. In addition, it may descend toward the outsole 200 when a load or shock is applied, and may ascend away from the outsole 200 by the elastic force of the spring 100.

The upper sole 300 may be firmly attached to the outsole 200 by bonding, and an insole of the shoe may be seated on the top surface thereof.

The lower spring seat 400 is a component configured to support the lower end of the spring 100 and may be provided on the top surface of the outsole 200 as shown in FIG. 3.

Specifically, the lower spring seat 400 may be formed in an annular groove shape to allow the lower end of the spring 100 to be seated thereon.

The lower spring seat 400 may be integrated with the outsole 200, and may be configured separately from the outsole 200 and securely fixed to the top surface of the outsole 200 through a fixing member including bonding.

The upper spring seat 500 is a component configured to support the upper end of the spring 100 and may be provided on the bottom surface of the upper sole 300 as shown in FIG. 3.

Specifically, the upper spring seat 500 may be formed in an annular groove shape such that the upper end of the spring 100 is in close contact therewith.

This upper spring seat 500 may be integrated with the upper sole 300, or may be configured separately from the upper sole 300 and firmly fixed to the bottom surface of the upper sole 300 through a fixing member including bonding.

That is, the spring 100 may be arranged interposed between the upper sole 300 and the outsole 200 as the upper and lower ends thereof are seated on the upper spring seat 500 and the lower spring seat 400, respectively. Thus, the spring may perform shock absorption against the user's weight or shock.

The ascent/descent guider 600 is a component configured to prevent distortion of the spring 100 by connecting the outsole 200 and the upper sole 300 and rectilinearly guiding the ascent/descent of the upper sole 300.

For example, the ascent/descent guider 600 may include a guide shaft 610, a shaft holder 620, and a shaft engagement portion 630 as shown in FIG. 3.

The guide shaft 610, which is integrated with the lower spring seat 610 in a protruding manner, is a component that is coaxially arranged with the spring 100 and is configured to guide the ascent/descent of the upper sole 300 as it is fitted into the shaft holder 620.

The shaft holder 620 is a component into which the guide shaft 610 is fitted, and may define a hole in the upper spring seat 500 of the upper sole 400 to allow the guide shaft 610 to be fitted thereinto.

When the upper sole 400 is caused to descend by a load or to ascend by the spring 100, the shaft holder 620 may move in the longitudinal direction of the guide shaft 610 to rectilinearly guide the ascent or descent of the upper sole 300.

Here, the shaft holder 620 is formed to have a depth corresponding to the guide shaft 610, thereby preventing the upper end of the guide shaft 610 from protruding toward the insole.

The shaft engagement portion 630 is a component configured to couple the guide shaft 610 to the shaft holder 620 in a one-touch manner and prevent the guide shaft 610 from being arbitrarily separated from the shaft holder 620.

Specifically, the shaft engagement portion 610 may be formed to have an outer diameter larger than that of the shaft holder 620 such that the outer diameter may be expanded and contracted by external force. Accordingly, the outer diameter may be reduced by external force and then expanded once the portion is fully coupled to the shaft holder 620. Thereby, the portion may be prevented from being separated from the shaft holder 620.

The shaft engagement portion 630 may include, for example, a split shaft 631 and a split hook 632.

The split shaft 631, which is a component configured to be contracted by external force and to be stretched by the elastic force, may be formed to be split to have an open upper end and may extend upward while being integrated with the upper portion of the guide shaft 610.

That is, as the split shaft 631 has a split form with upper end open, it may be contracted when external force is applied thereto, and may be opened when the external force is removed.

Here, the split shaft 631 may be radially split into four parts on the top of the guide shaft 610 as shown in FIG. 4.

Accordingly, when external force is applied, the split shaft 631 may be contracted toward the center, and thus the outer diameter may be smoothly reduced.

The split hook 632 is a component that is engaged with the shaft holder 620 so as not to be separated.

Specifically, the split hook 632 may be formed in a conical shape at the upper end of the split shaft 631, and may be fitted into the shaft holder 620 as the outer diameter is reduced by the contraction of the split shaft 631. Then, the outer diameter may be increased by expansion of the split shaft 632 so as not to be separated from the shaft holder 620.

Accordingly, when an operator presses the upper sole 300 downward with the split hook 632 facing the shaft holder 620 in an assembly process of the upper sole 300 and the outsole 200, the split hook may be easily coupled to the shaft holder 620 in a one-touch manner as the outer diameter thereof is reduced by the shaft holder 620. After coupling is completed, the outer diameter may be increased again and thus the hook may be prevented from being arbitrarily separated from the shaft holder 620.

Therefore, in the shock-absorbing shoe using the spring according to the present disclosure, the outsole 200 and the upper sole 300 may be coupled so as not to be separated from each other due to the simplified configuration of the guide shaft 610, the shaft holder 620, and the shaft engagement portion 630 constituting the ascent/descent guider 600.

Figure 5:
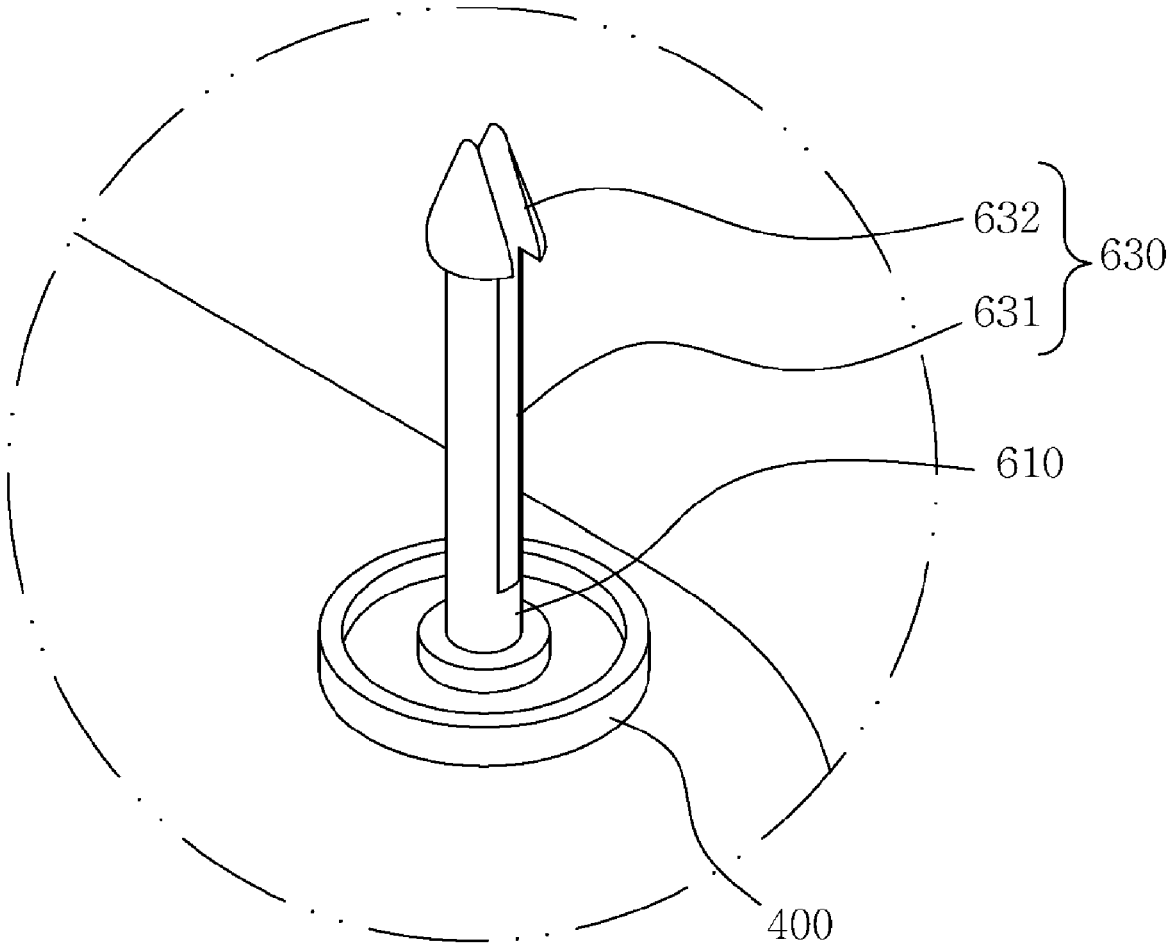
FIG. 5 is an enlarged perspective view showing a shaft engagement portion according to another embodiment of the present disclosure.

The above-described split shaft 631 may be composed of two split pieces as shown in FIG. 5.

In this case, as the two split shafts 631 are contracted toward each other or widened away from each other, the outer diameter thereof may be reduced or increased.

Figure 6:
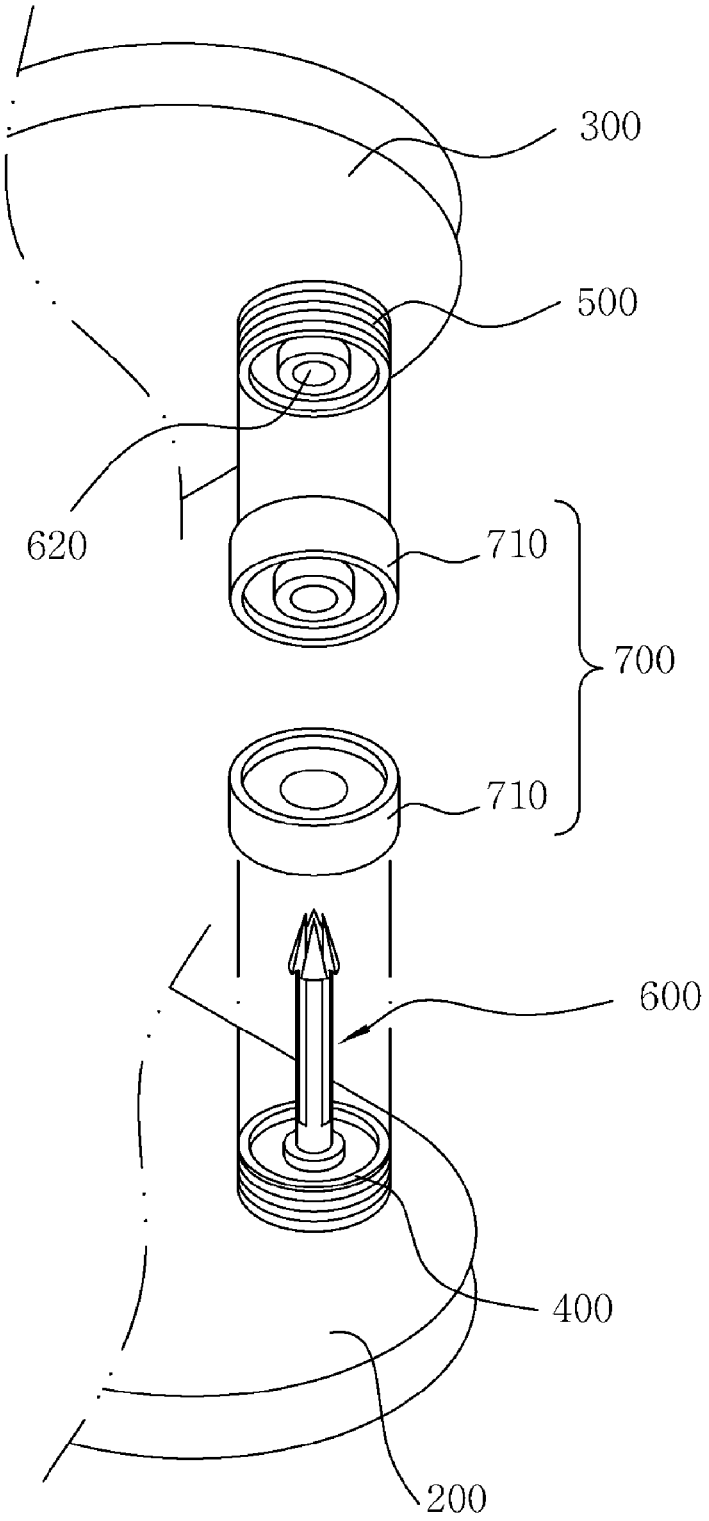
FIG. 6 is a perspective view showing the configuration of an elasticity adjuster according to the present disclosure.

The shock-absorbing shoe according to the present disclosure may further include an elasticity adjuster 700 as shown in FIG. 6.

The elasticity adjuster 700 is a component configured to adjust the elastic force by compressing or releasing the spring 100.

That is, the elasticity adjuster 700 may adjust the elastic force of the spring 100 by compressing or releasing the spring 100 by pressing at least one of both ends of the spring 100.

The elasticity adjuster 700 may include a seat cap 710 as shown in FIG. 6.

Specifically, the seat cap 710 may be screwed to the above-described lower spring seat 400 or upper spring seat 500 to face an end of the spring 100 while covering the seat.

The seat cap 710 may compress the spring 100 by moving toward the spring 100 while rotating in one direction or may release the spring 100 by moving away from the spring 100 while rotating in the opposite direction.

Here, when the spring 100 is compressed, the distance between the outsole 200 and the upper sole 300 decreases, and thus the height of the heel of the shoe is reduced. When the spring 100 is released, the distance between the outsole 200 and the upper sole 300 increases, and thus the height of the heel of the shoe is increased.

The seat cap 710 may be provided with a tool groove, not shown, on the outer circumferential surface thereof so as to be easily rotated by a tool, and may be provided with a stopper, not shown, on the inner circumferential surface thereof so as not to be separated from the lower spring seat 400 or the upper spring seat 500.

In addition, the seat cap 710 may have at least one locking protrusion formed on the inner circumferential surface thereof to prevent unintentional rotation, and a plurality of locking grooves corresponding to the locking protrusion may be formed on the outer circumferential surface of the lower spring seat 400 or the upper spring seat 500 and arranged in a circumferential direction. Thus, once the seat cap 710 is rotated stepwise only by a set angle corresponding to a gap between the locking grooves, it is prevented from rotating anymore.

As described above, in the shock-absorbing shoe using a spring according to an embodiment, as the ascent/descent guider 600 rectilinearly guides the ascent/descent of the upper sole 300 while connecting the outsole 200 and the upper sole 300, compression of the spring 100 is also rectilinearly performed. Accordingly, distortion of the spring 100 and the upper sole 300 may be prevented. In particular, as the shaft engagement portion 630 constituting the ascent/descent guider 600 includes the split shaft 631 and the split hook 632, the guide shaft 610 may be easily coupled to the shaft holder 620 in a one-touch manner, and may be prevented from being arbitrarily separated therefrom in the coupled state.

It will be understood by those of ordinary skill in the art to which the above-described embodiments belong that the above-described embodiments are for illustrative purposes only, and can be easily changed into other specific embodiments without departing from the technical idea or essential features of the above-described embodiments. Therefore, it should be understood that the above-described embodiments are illustrative and non-limiting in all respects. For example, each component described as a single item may be implemented in a distributed manner. Similarly, a component described as being distributed may be implemented in a coupled form.

The scope of protection sought for by the present disclosure is represented by the following claims, rather than the detailed description above, and should be interpreted as covering all changes or modifications derived from the meaning and scope of the claims and the concept equivalent thereto.

REFERENCE NUMERALS

100: Spring 200: outsole
300: Upper sole 400: Lower spring seat
500: Upper spring seat 600: Ascent/descent guider
610: Guide shaft 620: Shaft holder
630: Shaft engagement portion 631: Split shaft
632: Split hook

The invention claimed is:

1. A shock-absorbing shoe using a spring, the shock-absorbing shoe comprising:
- a spring configured to provide elastic force to absorb a shock;
- an outsole forming a sole of the shoe;
- an upper sole fixed to a top of the outsole and spaced apart from a heel of the outsole to provide a space for installation of the spring, the upper sole descending by a load or ascending by the elastic force of the spring;
- a lower spring seat formed on a top surface of the outsole to support a lower end of the spring;
- an upper spring seat formed on a bottom surface of the upper sole to support an upper end of the spring;
- an ascent/descent guider configured to rectilinearly guide an ascent/descent of the upper sole; and
- an elastic adjuster provided to at least one of the lower spring seat and the upper spring seat to adjust the elastic force of the spring,
- wherein a screw thread is formed on an outer circumferential surface of each of the lower spring seat and the upper spring seat, and
- wherein the elastic adjuster comprises a seat cap screwed to the screw thread of the lower spring seat or the upper spring seat to face an end of the spring while covering the lower spring seat or the upper spring seat such that the seat cap is configured to compress the spring through forward rotation or release the spring through reverse rotation.

2. The shock-absorbing shoe of claim 1, wherein the ascent/descent guider comprises:
- a guide shaft integrally protruding from the lower spring seat to be coaxially arranged with the spring;
- a shaft holder formed in a hole shape in the upper spring seat to allow the guide shaft to be fitted thereinto, the shaft holder being configured to move in a longitudinal direction of the guide shaft to guide the ascent/descent of the upper sole; and
- a shaft engagement portion formed on an upper portion of the guide shaft and having a larger outer diameter than the shaft holder, the shaft engagement portion being radially contractible and expandable to be engaged with the shaft holder so as not to be separated when fitted into the shaft holder.

3. The shock-absorbing shoe of claim 2, wherein the shaft engagement portion comprises:
- a split shaft integrally extending from an upper portion of the guide shaft, the split shaft being split to have an open upper end so as to be contracted by external force or restored by elastic force; and
- a split hook formed at the upper end of the split shaft in a conical shape, the split hook being fitted into the shaft holder by the constriction of the split shaft, and opened by restoration of the split shaft to be caught on the shaft holder.

4. The shock-absorbing shoe of claim 3, wherein the split shaft has four split pieces radially formed on an upper portion of the guide shaft.

* * * * *